US006701833B1

(12) United States Patent
van Haag et al.

(10) Patent No.: US 6,701,833 B1
(45) Date of Patent: Mar. 9, 2004

(54) CALENDER

(75) Inventors: Rolf van Haag, Kerken (DE); Ingo Engelhardt, Xanten (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 131 days.

(21) Appl. No.: 09/662,332

(22) Filed: Sep. 14, 2000

(30) Foreign Application Priority Data

Sep. 24, 1999 (DE) ..... 199 45 780

(51) Int. Cl.[7] ..... B30B 3/04; B30B 13/00

(52) U.S. Cl. ..... 100/163 A; 100/35; 100/47; 100/170; 100/171

(58) Field of Search ..... 100/162 B, 162 R, 100/47, 163 A, 168, 170, 176, 331, 169, 163 R, 35, 171

(56) References Cited

U.S. PATENT DOCUMENTS 4,620,477 A * 11/1986 Ripani et al. ..... 100/168
4,823,690 A * 4/1989 Stotz ..... 100/163 A
4,838,156 A 6/1989 Hafner et al.
4,890,551 A * 1/1990 Dahl et al. ..... 100/163 A
5,038,678 A * 8/1991 Honkala et al. ..... 100/163 A
5,662,037 A * 9/1997 van Haag ..... 100/162 B
5,806,415 A * 9/1998 Lipponen et al. ..... 100/163 A
5,911,174 A 6/1999 Cramer et al.
6,199,477 B1 * 3/2001 Brendel et al. ..... 100/161
6,248,215 B1 * 6/2001 Cramer et al. ..... 100/120

FOREIGN PATENT DOCUMENTS

DE 3803490 8/1989
DE 19633671 3/1998
DE 19832067 1/2000

* cited by examiner

*Primary Examiner*—Allen Ostrager
*Assistant Examiner*—Jimmy Nguyen
(74) *Attorney, Agent, or Firm*—Greenblum & Bernstein, P.L.C.

(57) ABSTRACT

Calender and process of calendering a web in calender. The calender includes a frame, an upper roll, a lower roll, an intermediate roll arrangement that includes an intermediate roll that is fixed in the frame, and a load limiting device coupled to the intermediate roll. The process includes loading the intermediate roll in two directions in a pressing plane direction via the upper and lower rolls, monitoring pressures exerted in the two directions on the intermediate roll in the pressing plane direction, and releasing the load on the intermediate roll when a difference between the pressures exerted in the two directions on the intermediate roll is greater than a predefined amount.

32 Claims, 3 Drawing Sheets

CALENDER

CROSS-REFERENCE TO RELATED APPLICATIONS

The present application claims priority under 35 U.S.C. §119 of German Patent Application No. 199 45 780.8, filed on Sep. 24, 1999, the disclosure of which is expressly incorporated by reference herein in its entirety.

BACKGROUND OF THE INVENTION

1. Field of the Invention

The present invention relates to a calender with a frame (seating), an upper roll that is embodied as a sag (deflection) compensation roll, a lower roll that is embodied as a sag compensation roll, and an intermediate roll arrangement with an intermediate roll that is fixed in the frame.

2. Discussion of Background Information

Such a calender is known from, e.g., published German Patent Application No. 198 32 067. In this calender, a roll stack is provided in which the upper roll and lower roll are embodied as sag compensation rolls. This possibility is not present for the rolls in the intermediate roll arrangement. However, one of the intermediate rolls is fixed in the frame so that the compressive strain conditions in the nips above the fixed intermediate roll and below the fixed intermediate roll can be freely adjusted to a large extent.

When using bending compensation rolls or sag compensation rolls in a roll stack, a differentiation is made between roll jackets that are mounted in a fixed manner, which are also known under the name "NIPCO K," and radially moveable roll jackets, also known as "NIPCO F." In the past, a combination of these roll types was used as the upper and lower roll in order to achieve a position-stable roll mounting. The use of two bending compensation rolls with roll jackets that are mounted in a stationary fashion was usually avoided because, in this case, the load coordination of the pressure transduction inside and outside the rolls is problematic because of the calender hydraulics. However, the combination of two radially moveable roll jackets requires a complicated regulation of the bearings of the roll stack, which should be prevented if possible. The simultaneous use of two bending compensation rolls with radially moveable roll jackets is advantageous, however, since only one roll type is being used in this case. Therefore, it is substantially easier to keep replacements on hand. Furthermore, calender hydraulics can be eliminated. This can be realized, among other things, in that the designated intermediate roll is mounted in its frame in a fixed manner in order to attain a geometric fixed point there.

SUMMARY OF THE INVENTION

The present invention improves the possibilities for affecting a material web. In particular, the instant invention is directed to a calender of the type mentioned at the outset in which the intermediate roll is provided with a load limiting device (over force safety device).

It is possible to introduce the treatment of the paper web in the individual nips up to the limits of the load capacity of the fixed intermediate roll. In general, the intermediate rolls of the intermediate roll arrangement, and therefore the fixed intermediate roll as well, are only dimensioned for a symmetrical load from two sides. Only in a limited range compared to the total load is a middle roll, and in particular the fixed intermediate roll, structured for flexural loading.

This flexural loading especially occurs when only one sag compensation roll is used in the assigned nip for producing compressive strain. But even in the case of strongly differing pressures in the upper and lower sag compensation roll, the danger exists of the intermediate roll being overloaded, which can lead to destruction. In any case, because such an error can be detected so quickly, it is fundamentally controllable. However, damages that do not become immediately apparent are critical. In this case, a section of material web that is treated after the damage can have a sharply decreased quality. If a load limiting device is used, the compressive strain in the nips can be brought as high as the intermediate roll can stand, if desired. Therefore, it is not necessary to maintain a large safe distance from the load limit, which increases the possibilities for treating material webs. There is also no risk of damaging the roll, which makes operation more reliable.

More preferably, the load limiting device has a release device that acts in a force-dependent manner which, if a predetermined threshold value is exceeded, causes a decrease in the force acting upon the intermediate roll. Therefore, the load limiting device not only indicates overloading, it acts to prevent an overloading of the fixed intermediate roll. If such a loading situation develops, the force oil the intermediate roll is decreased in a timely fashion.

Here, it is preferred for the intermediate roll to be mounted in levers and for the load limiting device to be arranged between at least one lever and the frame. The mounting of the intermediate rolls in levers is known from many calenders, i.e., so-called "lever calenders." If the load limiting device is arranged between the lever and the frame, the advantage of a lever translation can be used. In this case, the sensitivity of the load limiting device can be significantly improved.

Preferably, the load limiting device is arranged at both axial ends of the intermediate roll. The load limiting device then determines the forces at both axial ends of the intermediate roll. This device can not only determine an overloading, but also an asymmetric distribution of forces, which could cause a tilt or a skewed loading. This also facilitates the adjustment of the calender and/or its hydraulics or the hydraulics in the sag compensation roll at start-up or readjustment.

Preferably, the load limiting device also has a force indicator device. In this case, the forces acting on the individual mounting points of the intermediate roll can be transmitted to an operator or a monitoring program so that information about the loading of the individual mounting points is constantly kept ready. Besides the possibilities for documentation, this especially has the advantage that, at least in the case of the intermediate roll, i.e., in the middle of the calender, the information can be collected at all.

Preferably, the load limiting device also has a hydraulic support that acts on the intermediate roll or a mounting attached thereto from opposite sides essentially parallel to the press direction, with a comparison device being provided for the hydraulic pressure on both sides. With this type of support, a pressure difference measurement can be performed, so to speak, in order to determine exactly the force with which the roll or its mounting, e.g., the lever, is being loaded. Besides the simple load limiting device, it is possible using this embodiment to mechanically record the actual force acting on each mounting side of the fixed roll according to size and direction at every point in operation. This facilitates that adjustment of the correct load coordination in the upper and lower part of the roll stack. As mentioned above, an imbalance of forces or a tilt can thus be detected immediately.

Here, it is especially preferred for the comparison device to have a differential pressure valve that controls a quick unloading function, at least for one sag compensation roll. If a differential valve is used, it is not necessary to have a measured data conversion, i.e., converting hydraulic pressure into an electric control signal by way of a control device, e.g., SPS. The release of the lowering of the sag compensation roll, preferably the lower sag compensation roll, occurs automatically in the case of a predetermined differential pressure being exceeded. This guarantees a relatively secure flow of signals.

The hydraulic support is preferably embodied in a hydrostatic manner. This achieves the further advantage of greatly dampening the roll vibrations.

As an alternative, the hydraulic support can have two prestressed hydraulic cylinders. When force is exerted on the roll, the pressure must increase in one cylinder and decrease in the other. This can be achieved independently in that the oil volumes located in the cylinders are closed in. Because an absolutely leakage-free seal of the cylinders is difficult to achieve, an accumulator can be provided for this embodiment. Upon reaching a defined maximum pressure in one cylinder, the quick unloading of the intermediate roll is initiated in that the pressures in the corresponding sag compensation roll are decreased.

Finally, in a further embodiment, the load limiting device can be provided with a spring device and a path length dependent sensor. The connection between force, springs and path is a general physical law. Therefore, by monitoring the compression or extension of a spring, it is possible to determine the force acting on the intermediate roll. This spring monitoring can be installed in a relatively cost-effective manner.

Here, it is preferred for the spring device to be embodied with disk springs connected in a parallel manner. They have a high degree of stiffness and therefore cause only a negligible displacement so that the geometry of the roll stack is not significantly influenced. Furthermore, disk springs have good vibration dampening behavior, which has a positive effect on the casters of the calender.

As an alternative to this, the spring device can also be formed by a roll axis. This embodiment is advantageous because no additional components are necessary. "Roll axis" should not be understood here to mean a physically present component in the sense of a rod passing through the roll. Many rolls, e.g., heated rolls, have only roll pins on their face ends. Under nominal load, for example, the sag of such a pin in the area between the roll body and the mounting lies between about 0.3 and 0.5 mm. Such a sagging can be easily detected using measurement methods, even if such a roll is not mounted in levers, but rather directly in the frame.

Preferably, the sensor is embodied as an end position switch. When, due to a force acting on the intermediate roll, a certain deflection is achieved against the force of the springs or against the roll axis acting as springs or the pins, the end position switch(es) is/are activated and the pressure in the sag compensation rolls or the outer cylinders that are exerting the corresponding forces can be moved back.

As an alternative, the sensor can be embodied as a contact-free vicinity sensor. In this case, the approach of the intermediate roll towards a critical position, and thus the build-up of critical forces, can be monitored. In many cases, vicinity sensors operating in a contact-free manner are also less sensitive, which is advantageous for the operation in a calender.

Finally, in a further alternative, the load limiting device can be embodied as a sheering pin. This is a very simple embodiment. When the force acting on the fixed intermediate roll exceeds a predetermined value, the pin sheers and the lever moves into an end position. There, it can trigger the end switch that activates the quick unloading of the roll hydraulics. The only condition for this is that the breaking load of the pin must be constructed as being lower, as a rule, significantly lower, than that of the roll. This solution is relatively cost-effective. It is especially to be recommended when the calender has already been adjusted correctly because, in this case, overloading situations are actually not to be expected, at least not as often.

The present invention is directed to a calender. The calender includes a frame, an upper roll, a lower roll, an intermediate roll arrangement that includes an intermediate roll that is fixed in the frame, and a load limiting device coupled to the intermediate roll.

Further, the upper and lower rolls can include sag compensation rolls. The intermediate roll may be fixed in the frame by a substantially non-pivoting lever.

In accordance with a feature of the invention, the load limiting device may include an activation device that reacts in a force-dependent manner. When a predetermined threshold value is exceeded, the activation device can be arranged to decrease the force acting on the intermediate roll.

According to another feature of the instant invention, the intermediate roll can be mounted in levers and the load limiting device can be arranged between at least one of the levers and the frame.

The load limiting device can be arranged at both axial ends of the intermediate roll. Further, the load limiting device can include a force indicator device.

Moreover, the load limiting device can include a hydraulic support which acts on one of the intermediate roll and a fixture coupled to the intermediate roll from opposite sides and essentially parallel to a pressing direction. The load limiting device can further include a comparison device arranged to compare hydraulic pressures on both sides of the one of the intermediate roll and the fixture coupled the intermediate roll. The comparison device can include a differential pressure valve structured and arranged to control a quick unloading function at least for one of the upper and lower rolls. Further, the hydraulic support can include a hydrostatic support. Still further, the hydraulic support may include two hydraulic cylinders that are prestressed in opposition to one another.

In accordance with a further feature of the present invention, the load limiting device can include a spring device and a path length dependent sensor. The spring device can include spring disks coupled in a parallel manner. Moreover, the spring device can be formed by a roll axis. Still further, the path length dependent sensor can include an end position switch. Additionally or alternatively, the path length dependent sensor can include a contact-free vicinity sensor.

According to a still further feature of the invention, the load limiting device can include a sheering pin.

The present invention is directed to a calender that includes a frame, an intermediate roll arrangement having an intermediate roll that is substantially positionally fixed relative to a pressing plane direction, and a load limiting device coupled to the intermediate roll.

According to a feature of the instant invention, the calender can further include an upper sag compensation roll positioned above the intermediate roll arrangement, and a lower sag compensation roll positioned below the intermediate roll arrangement. Moreover, upper cylinder piston arrangements may be coupled to the upper sag compensation roll, so that the upper cylinder piston arrangements are arranged to move the upper sag compensation roll toward the intermediate roll, and lower cylinder piston arrangements may be coupled to the lower sag compensation roll, so that the lower cylinder piston arrangements are arranged to move the lower sag compensation roll toward the intermediate roll. Further, an actuation device can be arranged for quickly releasing the pressure applied by at least one of the upper and lower sag compensation rolls. Still further, an actuation device can be arranged for quickly releasing the pressure applied to the intermediate roll.

In accordance with another feature of the present invention, a device for monitoring forces exerted on the intermediate roll in the pressing plane direction can be included. Further, when the monitored forces exerted on one side of the intermediate roll exceed the monitored forces on the other side of the intermediate roll by a predetermined amount, forces exerted on the intermediate roll may be released.

According to still another feature of the present invention, a device for monitoring deflection distances of bearing pins of the intermediate roll in the pressing plane direction can be included. Further, when the monitored deflection distances of the bearing pins in one direction exceed the monitored deflection distances of the bearing pins in the other direction by a predetermined amount, forces exerted on the intermediate roll can be released. Still further, forces exerted on the intermediate roll in the pressing plane direction can cause deflection of the intermediate roll and of the bearing pins, and, when monitored deflection distances of the bearing pins in one direction which are greater than monitored deflection distances of the bearing pins in the other direction by more than a predetermined amount, an actuator may release pressure on the intermediate roll in the pressing plane direction.

In accordance with yet another feature of the instant invention, spring disks and end position switches can be included. The spring disks may be positioned to prevent movement of the intermediate roll in the pressing plane direction, and the end position switches may be arranged to indicate movement greater than a predetermined amount of the intermediate roll in the pressing plane direction.

The present invention is directed to a process of calendering a web in a calender that includes a frame, an upper and a lower roll, an intermediate roll arrangement having an intermediate roll that is fixed in the frame, and a load limiting device coupled to the intermediate roll. The process includes loading the intermediate roll in two directions in a pressing plane direction via the upper and lower rolls, monitoring pressures exerted in the two directions on the intermediate roll in the pressing plane direction, and releasing the load on the intermediate roll when a difference between the pressures exerted in the two directions on the intermediate roll is greater than a predefined amount.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
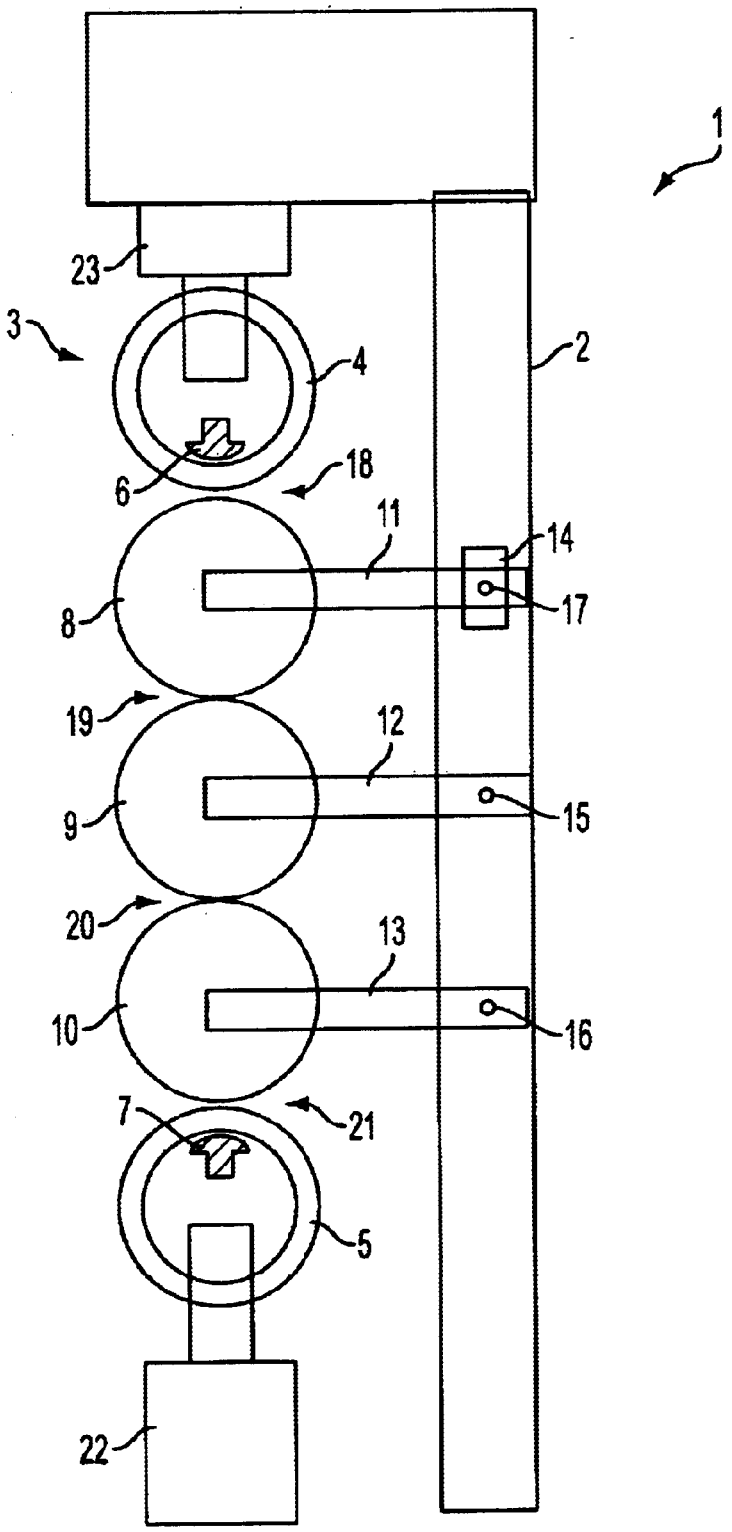
FIG. 1 schematically illustrates a side view of a calender in accordance with the features of the invention.

FIG. 1 shows a calender 1 with a frame (seating) 2 in which a roll stack 3 is arranged. Roll stack 3 is formed by five rolls, of which uppermost roll 4 and lowermost roll 5 are formed by sag (deflection) compensation rolls, which is schematically depicted by hydrostatic support elements 6 and 7. Rolls 4 and 5 can be, e.g., so-called jacket lift rolls, in which the roll jackets are moveable in a direction of the pressing plane in relation to a fixed carrier (not shown in detail). The pressing plane is a plane in which the axes of all the rolls in roll stack 3 are arranged.

Between end rolls 4 and 5 are three intermediate rolls 8, 9, and 10 which do not have the possibility of sag compensation and which form an intermediate roll arrangement. Intermediate rolls 8–10 are mounted in levers 11–13 which are in turn hung in frame 2. Here, lever 11 of uppermost intermediate roll 8 is fixed in frame 2, which is schematically depicted by a fixing device 14. Both levers 12 and 13 are pivotable around pivot points 15 and 16, respectively. A pivot point 17 is also provided for lever 11, as shall be explained below.

Because lever 11 is fixed in frame 2, a compressive strain can be set in a nip 18 between uppermost roll 4 and intermediate roll 8, independently of the compressive strain in other nips 19–21. This results in expanded influencing possibilities in the treatment of a material web (not shown in greater detail). Naturally, other levers can be fixed in frame 2, e.g., lever 12 or lever 13.

Sag compensation rolls 4 and 5 are arranged on hydraulically activated piston-cylinder units 22 and 23, which can be used to cause a further movement of the entire roll 4 and 5 toward their respectively adjacent rolls, as well as to support a quick separation. Such piston-cylinder units 22 and 23 can also be used when sag compensation rolls 4 and 5 are not formed as a jacket lift, but rather have roll jackets that are mounted in a stationary manner.

Like the two intermediate rolls 9 and 10, intermediate roll 8 is only constructed for an essentially symmetrical load from two sides. This does not cause any problems in two intermediate rolls 9 and 10 because rolls 9 and 10 can move upwardly with their levers 12 and 13, respectively, in the case of a loading from below. This is not a possibility for intermediate roll 8, which is fixed in frame 2. Correspondingly, there is the danger that fixed intermediate roll 8 will be damaged in the case of too high one-sided pressures, e.g., either the mounting of intermediate roll 8 or intermediate roll 8 itself. Such a situation can especially occur when sag compensation roll 4 is working with different forces from sag compensation roll 5. The situation can become especially critical when uppermost nip 18 is kept pressure-free and the treatment of a material web only occurs in other nips 19–21 or vice versa.

Therefore, in order to make this problem less critical, a load limiting device is provided. FIGS. 2–6 show various exemplary embodiments for such load limiting devices. However, it is noted that the depicted load limiting devices should not be construed as limiting the instant invention, i.e., various other undepicted load limiting devices can be utilized without departing from the scope of the instant invention. Further, parts corresponding to those in FIG. 1 have been provided with the same reference characters.

Figure 2:
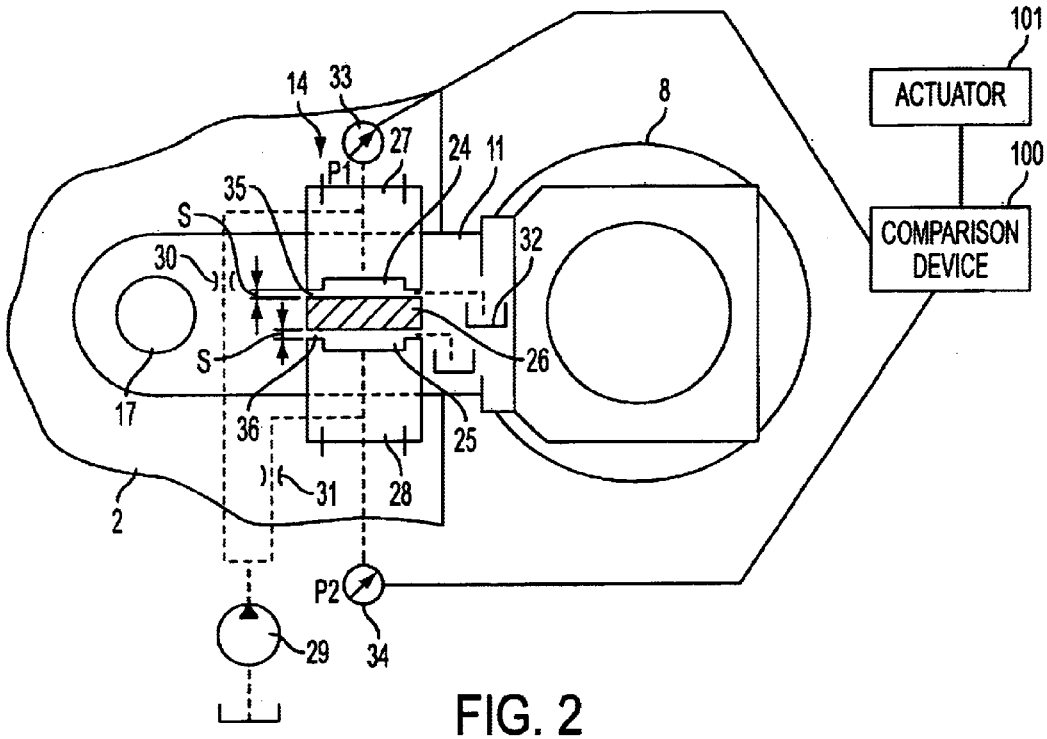
FIG. 2 illustrates an exemplary embodiment of a load limiting device for use with the calender depicted in FIG. 1.

FIG. 2 shows an embodiment in which lever 11 is supported from both sides, i.e., from above and below, with hydrostatic oil cushions 24 and 25. For this purpose, lever 11 is provided with a crosswise traverse 26 to which adjacent support shoes 27 and 28 are assigned. Each support shoe 27 and 28 is arranged to form a pressure pocket for oil cushions 24 and 25. The pressure pockets are kept under pressure using hydraulic oil by way of a pressure pump 29 and throttles 30 and 31. Support shoes 27 and 28 are supported on frame 2, and containers 32 are provided for back-flowing oil. The pressure of oil cushions 24 and 25, i.e., the pressure in the pressure pockets, is determined by manometers 33 and 34 (i.e., pressures P1 and P2, respectively). Thus, by a differential pressure measurement, the exact force with which lever 11 is being loaded can be determined. If this differential force and/or differential pressure exceeds a defined maximum value, determined, e.g., with a comparison device 100, the quick unloading function of the rolls is initiated, e.g., via an activation device 101. This can occur, e.g., in a purely hydraulic manner by a differential pressure valve (not shown in greater detail) so that no conversion of measured values, e.g., hydraulic pressure into an electric control signal, by way of a control device, e.g., SPS, is necessary. This increases security in the flow of signals. Besides simple safeguarding against overloading, this device also allows for the possibility of mechanically recording the actual force acting on each mounting side of fixed roll 8 according to size and direction at every point in operation. This allows for a substantial simplification in setting the correct load coordination in the upper and lower part of roll stack 2. An imbalance of forces or a tilt can thus be immediately recognized.

The hydrostatic mounting of the lever additionally achieves a large degree of dampening against roll vibrations.

Instead of measurement of pressure, the size of a gap 35 and 36 between support shoes 27 and 28, respectively, and traverse 26 can be measured. In the case of balanced forces, both gaps 35 and 36 have a substantially same thickness S.

With the aid of pressure cushions 24 and 25, it is also achieved that lever 11 is held firmly in frame 2.

Figure 3:
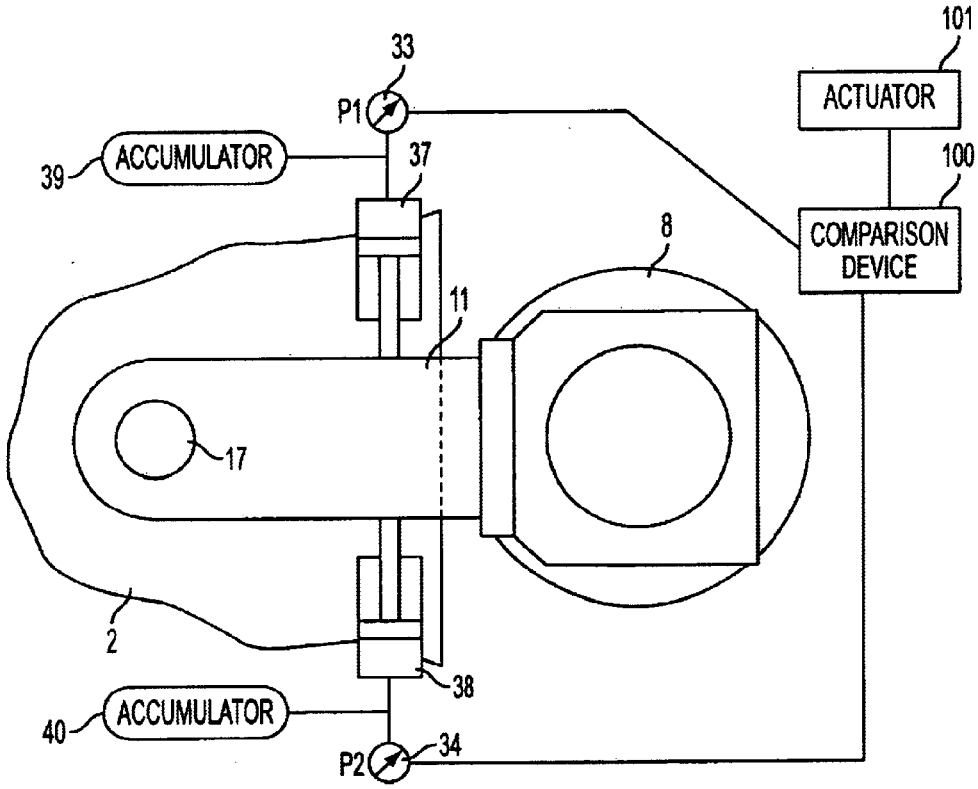
FIG. 3 illustrates another embodiment of the load limiting device for use with the calender depicted in FIG. 1.

FIG. 3 shows an alternative embodiment that also operates hydraulically. Here, the lever 11 is held from above and below with hydraulic cylinders 37, 38. Hydraulic cylinders 37 and 38 are prestressed with a constant pressure. When force acts on lever 11, the pressure in one of cylinders 37 and 38 must increase and the pressure in the other cylinder must decrease. This can be achieved automatically in that the oil volumes located in cylinder 37 and 38 are sealed in. Because this requires an absolutely leakage-free seal of hydraulic cylinders 37 and 38, this manner of operation can be made easier by accumulators 39 and 40. Upon reaching a defined maximum differential pressure, determined, e.g., via comparison device 100, the quick unloading of the rolls is also initiated, e.g., via actuation device 101.

Figure 4:
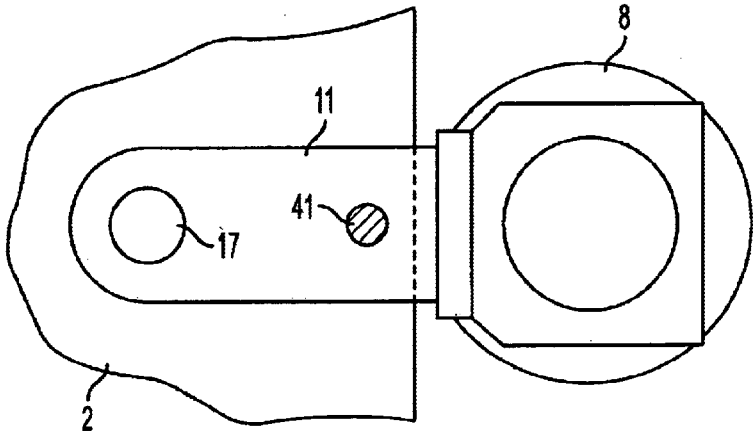
FIG. 4 illustrates still another embodiment of the load limiting device for use with the calender depicted in FIG. 1.

FIG. 4 shows an embodiment of a load limiting device that can be achieved without expensive modifications. Between lever 11 and frame 2 is arranged a sheering pin 41 which holds lever 11 in its fixed position to frame 2. If a force acting on lever 11 exceeds a certain value, pin 41 sheers and lever 11 moves into an end position. There, it can trigger an end switch (not shown in greater detail) that activates the quick unloading of the roll hydraulics.

The breaking load of sheering pin 41 must be constructed as being lower, and as a rule, significantly lower, than that of roll 8. One disadvantage of this variant is that, in the start-up phase in which calender I has not yet been adjusted completely correctly, many breaks of sheering pin 41 can occur. For this reason, further measures can be taken during the start-up phase in order to limit the forces acting on roll 8 and use sheering pin 41 only when the start-up phase is completed.

Figure 5:
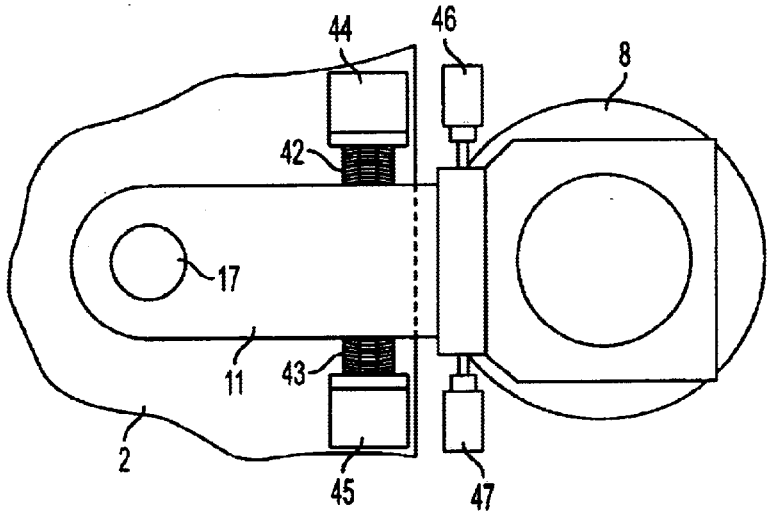
FIG. 5 illustrates yet another embodiment of the load limiting device for use with the calender depicted in FIG. 1.

FIG. 5 shows a further alternative embodiment in which lever 11 is supported with the aid of two spring assemblies 42 and 43 across from stops 44 and 45 that are fixed in frame 2. Lever 11 is slightly deflected by a one-sided roll loading.

Springs 42 and 43 are dimensioned in such a way that the end position switches 46 and 47 are reached and activated only after a certain maximum load has been exceeded Because only short paths must be covered and a high degree of stiffness is advantageous, disk springs connected in a parallel manner are used here. This also results in a good dampening of vibrations, which has a positive effect on the smoothness of operation of the calender 1.

The load limiting devices discussed up to now were described in connection with intermediate roll 8, which is hung, and fixed, in frame 2 by lever 11. However, a load limiting device can also be used in rolls that are immediately fixed in frame 2. This will be explained in greater detail with reference to FIG. 6.

Figure 6:
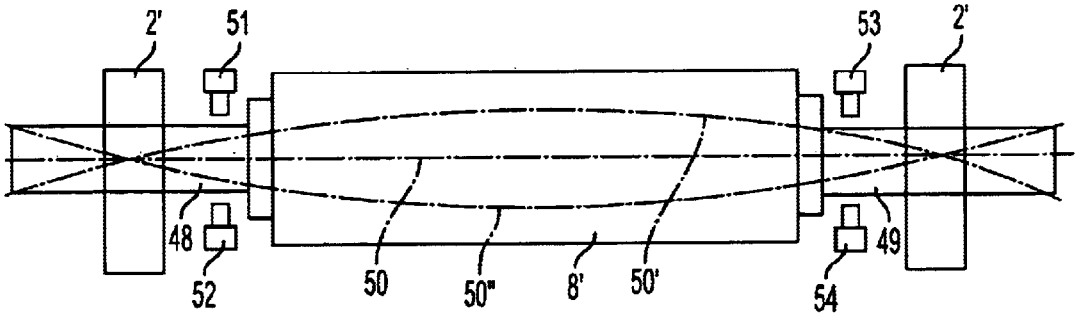
FIG. 6 illustrates still yet another embodiment of the load limiting device for use with the calender depicted in FIG. 1.

FIG. 6 shows a roll 8', e.g., a heated roll, that can also be fixed in a frame 2' without the intermediate connection to levers. Roll 8' has roll pins 48 and 49 that are mounted in frame 2'. Roll 8' can be provided, e.g., with heat transfer fluid by way of roll pins 48 and 49 (not shown in greater detail). If a resulting force now acts on roll 8' on one side in one direction, then roll 8' and, thus, its roll pins 48 and 49 will bend. This is shown to an exaggerated degree with dot-dash lines in FIG. 6. Axis 50 forms a straight line when roll 8' is in balance. When a force is acting on roll 8' from below, it bends upwardly, as shown by line 50' and, when a force is acting on roll 8' from above, it bends downwardly, as shown by line 50". In heated roll 8' as shown, the sagging of pins 48 and 49 lies at, e.g., between about 0.3 and 0.5 mm under nominal load in the region between the roll body and mounting in frame 2'.

Four path recorders 51–54 can be provided that operate in a contact-free manner, e.g., inductively. They may be arranged in two directions in the roll plane at both axial ends of roll 8'. Naturally, more path recorders can also be provided, including outside the roll plane (i.e., the plane in which the axes of all rolls in the calender 1 lie).

As shown, roll 8' and its roll pins 48 and 49 will sag under pressure. Roll 8' and its pins 48 and 49 can be seen as large springs. When the bending exceeds a predetermined degree, it can also be assumed that the force is correspondingly large. Path recorders 51–54 can then indicate the applicable "spring condition" and/or produce a signal that activates a quick separation of the rolls. Contact-free path recorders, which can also be used in the exemplary embodiments depicted in FIGS. 2 to 5, have the advantage that they do not just activate precisely at the moment when the maximum force is exceeded, but rather make it possible to take counter measures before the maximum force is exceeded. It is furthermore possible to constantly record the force progression during a treating process, e.g., a glazing operation, in order to allow better quality control.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A calender comprising:

a frame;

an upper roll coupled to said frame;

a lower roll coupled to said frame;

an intermediate arrangement, located between said upper and lower rolls, comprising an intermediate roll that is fixed in said frame; and an over force safety device coupled to said intermediate roll.

2. A calender comprising:

a frame;

an upper roll coupled to said frame;

a lower roll coupled to said frame;

an intermediate arrangement, located between said upper and lower rolls, comprising an intermediate roll that is fixed in said frame; and an over force safety device coupled to said intermediate roll, wherein said over force safety device is arranged to disengage the intermediate roll from a force directed against the intermediate roll that is capable of damaging the intermediate roll.

3. The calender in accordance with claim 2, wherein said upper and lower rolls comprise sag compensation rolls.

4. The calender in accordance with claim 3, wherein said intermediate roll is fixed in said frame by a substantially non-pivoting lever.

5. The calender in accordance with claim 2, said over force safety device comprising an activation device that reacts in a force-dependent manner, wherein, when a predetermined threshold value is exceeded, said activation device is arranged to decrease the force acting on said intermediate roll.

6. The calender in accordance with claim 2, wherein said intermediate roll is mounted in levers and said load limiting device is arranged between at least one of said levers and said frame.

7. The calender in accordance with claim 2, wherein said over force safety device is arranged at both axial ends of said intermediate roll.

8. The calender in accordance with claim 7, wherein said over force safety device comprises a force indicator device.

9. The calender in accordance with claim 2, wherein said load limiting device comprises a spring device and a path length dependent sensor.

10. The calender in accordance with claim 9, wherein said spring device comprises spring disks coupled in a parallel manner.

11. The calender in accordance with claim 9, wherein said spring device is formed by a roll axis.

12. The calender in accordance with claim 9, wherein said path length dependent sensor comprises an end position switch.

13. The calender in accordance with claim 9, wherein said path length dependent sensor comprises a contact-free vicinity sensor.

14. The calender in accordance with claim 2, wherein said load limiting device comprises a sheering pin.

15. A calender comprising:

a frame;

an upper roll coupled to said frame;

a lower roll coupled to said frame;

an intermediate arrangement, positioned between said upper and lower rolls, comprising an intermediate roll that is fixed in said frame via a fixture; and an over force safety device coupled to said intermediate roll, wherein said over force safety device comprises a hydraulic support which acts on one of said intermediate roll and a fixture coupled to said intermediate roll from opposite sides and essentially parallel to a pressing plane passing through axes of said upper roll and said lower roll.

16. The calender in accordance with claim 15, wherein said over force safety device further comprises a comparison device arranged to compare hydraulic pressures on both sides of said one of said intermediate roll and said fixture coupled to said intermediate roll.

17. The calender in accordance with claim 15, wherein said hydraulic support comprises two hydraulic cylinders that are prestressed in opposition to one another.

18. A calender comprising:

a frame;

an upper roll coupled to said frame;

a lower roll coupled to said frame;

an intermediate arrangement, located between said upper and lower rolls, comprising an intermediate roll that is fixed in said frame via a fixture; and an over force safety device coupled to said intermediate roll, wherein said over force safety device comprises a hydraulic support which acts on one of said intermediate roll and said fixture coupled to said intermediate roll from opposite sides and essentially parallel to a pressing direction, wherein said over force safety device further comprises a comparison device arranged to compare hydraulic pressures on both sides of said one of said intermediate roll and said fixture coupled to said intermediate roll, and wherein said comparison device comprises a differential pressure valve structured and arranged to control a quick unloading function at least for one of said upper and lower rolls.

19. A calender comprising:

a frame;

an upper roll coupled to said frame;

a lower roll coupled to said frame;

an intermediate arrangement, located between said upper and lower rolls, comprising an intermediate roll that is fixed in said frame via a fixture; and an over force safety device coupled to said intermediate roll, wherein said over force safety device comprises a hydraulic support which acts on one of said intermediate roll and said fixture coupled to said intermediate roll from opposite sides and essentially parallel to a pressing direction, and wherein said hydraulic support comprises a hydrostatic support.

20. A calender comprising:

a frame;

an intermediate arrangement comprising an intermediate roll, rotatably coupled to said frame, that is substantially positionally fixed relative to said frame; and an over force safety device coupled to said intermediate roll.

21. A calender comprising:

a frame;

an intermediate arrangement comprising an intermediate roll, coupled to said frame, that is substantially positionally fixed relative to said frame; and an over force safety device coupled to said intermediate roll, wherein said over force safety device is arranged to disengage the intermediate roll from a force directed against the intermediate roll that is capable of damaging the intermediate roll.

22. The calender in accordance with claim 21, further comprising:

an upper sag compensation roll positioned above said intermediate arrangement; and a lower sag compensation roll positioned below said intermediate arrangement.

23. The calender in accordance with claim 22, further comprising:

upper cylinder piston arrangements coupled to said upper sag compensation roll, said upper cylinder piston arrangements arranged to move said upper sag compensation roll toward said intermediate roll; and lower cylinder piston arrangements coupled to said lower sag compensation roll, said lower cylinder piston arrangements arranged to move said lower sag compensation roll toward said intermediate roll.

24. The calender in accordance with claim 22, further comprising an actuation device arranged for quickly releasing the pressure applied by said upper compensation roll and/or said lower sag compensation roll.

25. The calender in accordance with claim 22, further comprising an actuation device arranged for quickly releasing the pressure applied to the intermediate roll.

26. The calender in accordance with claim 21, further comprising a device for monitoring forces exerted on said intermediate roll in the pressing plane direction.

27. The calender in accordance with claim 26, wherein, when said monitored forces exerted on one side of said intermediate roll exceed said monitored forces on the other side of said intermediate roll by a predetermined amount, forces exerted on said intermediate roll are released.

28. The calender in accordance with claim 21, further comprising a device for monitoring deflection distances of bearing pins of said intermediate roll in the pressing plane direction.

29. The calender in accordance with claim 28, wherein, when said monitored deflection distances of said bearing pins in one direction exceed said monitored deflection distances of said bearing pins in the other direction by a predetermined amount, forces exerted on said intermediate roll are released.

30. The calender in accordance with claim 28, wherein, forces exerted on said intermediate roll in the pressing plane direction cause deflection of said intermediate roll and of said bearing pins, and wherein, when monitored deflection distances of said bearing pins in one direction which are greater than monitored deflection distances of said bearing pins in the other direction by more than a predetermined amount, an actuator releases pressure on said intermediate roll in said pressing plane direction.

31. The calender in accordance with claim 21, further comprising spring disks and end position switches, wherein said spring disks are positioned to prevent movement of said intermediate roll in the pressing plane direction, and wherein said end position switches are arranged to indicate movement greater than a predetermined amount of said intermediate roll in the pressing plane direction.

32. A process of calendering a web in a calender that includes a frame, an upper and a lower roll, an intermediate arrangement having an intermediate roll that is fixed in the frame, and an over force safety device coupled to the intermediate roll, said process comprising:

loading the intermediate roll in two directions in a pressing plane direction via the upper and lower rolls;

monitoring pressures exerted in the two directions on the intermediate roll in the pressing plane direction; and releasing the load on the intermediate roll when a difference between the pressures exerted in the two directions on the intermediate roll is greater than a predefined amount.

* * * * *